United States Patent [19]

Gebert

[11] Patent Number: 4,947,433

[45] Date of Patent: Aug. 7, 1990

[54] CIRCUIT FOR USE IN PROGRAMMABLE HEARING AIDS

[75] Inventor: Anton M. Gebert, Union, N.J.

[73] Assignee: Siemens Hearing Instruments, Inc., Piscataway, N.J.

[21] Appl. No.: 330,339

[22] Filed: Mar. 29, 1989

[51] Int. Cl.[5] ..... H04R 25/00

[52] U.S. Cl. ..... 381/68; 381/68.2

[58] Field of Search ..... 381/68, 68.2, 68.4

[56] References Cited

U.S. PATENT DOCUMENTS

| | | | |
|---|---|---|---|
| 4,187,183 | 2/1980 | Moser | 381/68 |
| 4,396,806 | 8/1983 | Anderson | 179/107 |
| 4,471,171 | 9/1984 | Köpke et al. | 381/68 |

FOREIGN PATENT DOCUMENTS

| | | | |
|---|---|---|---|
| 0250679 | 1/1988 | European Pat. Off. | 381/68 |
| 2184629 | 6/1987 | United Kingdom . | |

OTHER PUBLICATIONS

European Patent Application No. 0 071 845, 20 pages.

*Primary Examiner*—Jin F. Ng
*Assistant Examiner*—M. Nelson McGeary, III
*Attorney, Agent, or Firm*—Mark H. Jay

[57] ABSTRACT

A circuit for use in programmable hearing aids is programmed by inputting digital pulses along two input lines. The programmed information is stored in ring counters and then registered in EEPROMS. A multiplexer (itself a ring counter) selects the ring counter which will be incremented by pulses input to one of the input lines.

5 Claims, 14 Drawing Sheets

| FIG. 13A | FIG. 13B | FIG. 13C |
|---|---|---|

LOGIC FLOW DIAGRAM

CIRCUIT FOR USE IN PROGRAMMABLE HEARING AIDS

BACKGROUND OF THE INVENTION

The invention relates to hearing aids, and more particularly relates to ITE and canal hearing aids. In its most immediate sense, the invention relates to programmable ITE and canal hearing aids.

It has long been desired to manufacture a hearing aid in which many circuit variables may be adjusted by the dispenser. In practice, this has proved difficult in ITE and canal hearing aids.

The difficulties have resided in the severe constraints which space considerations impose on the hearing aid circuitry. Where adjustment of the hearing aid has been accomplished by adjustment of potentiometers, the number of potentiometers has been limited by the small volume in which they must be installed. Where adjustment of the hearing aid has been accomplished using hand-held programmers which activate digital circuitry in the hearing aid, the space requirements for serial ports, microprocessors, filters etc. have likewise limited available design options.

Circuit adjustability has also long been recognized as desirable for reasons of manufacturing economy. Where an ITE hearing aid has been manufactured and proves, on final test, to be out of electrical specifications, it is necessary to cut the device open, to replace one or more hard-wired parts, and to reseal the housing. This is not only labor-intensive and therefore expensive, but the fine wires inside the hearing aid may become overstressed and break. Major rework may consequently be required. While it is possible to avoid this sort of quality-control-related rework by providing additional potentiometers to be adjusted at the factory, this limits the number of potentiometers which can be adjusted by the dispenser and can even be disadvantageous because dispensers might meddle with adjustments which are intended exclusively for factory technicians.

It would therefore be advantageous to provide a hearing aid circuit which would permit many electrical variables to be adjusted, both at the factory and at the dispenser's office, without being so large as to require a BTE construction.

SUMMARY OF THE INVENTION

One object of the invention is to provide a hearing aid circuit which permits many different circuit variables to be changed without being too large for use in an ITE or canal hearing aid.

Another object is to provide such a circuit which can be easily programmed at the factory and at the dispenser's office.

A further object is to provide such a circuit which permits a high degree of standardization at the factory.

Yet another object is to provide such a circuit which is versatile enough to use in a wide variety of applications without requiring substantial customization.

Still a further object is, in general, to improve on existing hearing aid circuits.

In accordance with the invention, electrical characteristics of the signal processing circuity between the microphone and receiver are varied by variable electrical elements. These elements may be, e.g., switch networks and switched resistive networks. For each variable electrical element (i.e. for each switch, group of switches, switched resistive network, as the case may be) there is provided a means for storing information. The means for storing information has a plurality of states, which states correspond to electrical values of the associated variable electrical element. Thus, for example, where the variable electrical element is a variable resistor formed from a switched resistive network, and where the variable resistor can have 21 different discrete resistances, the associated storing means will have 21 different states. Each of the storing means changes states upon receipt of digital pulses.

A first input is provided for receipt of digital pulses, and this input is connected to a multiplexer. The multiplexer connects this input to individual ones of the storing means. Thus, when for example a value for the overall circuit gain is to be programmed into the hearing aid circuitry, the multiplexer connects the pulse input to that storing means which is associated with that variable electrical element which adjusts overall circuit gain. Then, when digital pulses are presented to the input, the storing means is brought to the appropriate state. The multiplexer may then be adjusted to another state, in which the pulse input is connected to another storing means which is to be programmed.

As a result of this architecture, only three terminals are needed to program the hearing aid: a ground, the above-described first input, and another input for the multiplexer.

Advantageously, and in the preferred embodiment, the storing means and the multiplexer are implemented as ring counters, each counter having an index state in which its impedance is different from its impedance in all its other states. This permits an external programming unit to detect that the multiplexer or storing means is in the index state, permitting the multiplexer or storing means to be brought to the desired state merely by sending the proper number of pulses into the hearing aid circuit.

Further advantageously, and in the preferred embodiment, each of the storing means has two sections: a volatile section and a nonvolatile section. In use, the volatile sections are programmed and then the contents of the volatile sections are stored in the nonvolatile sections when all programming has been properly accomplished. This is still further advantageously implemented using EEPROMs for the nonvolatile sections.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

Figure 1:
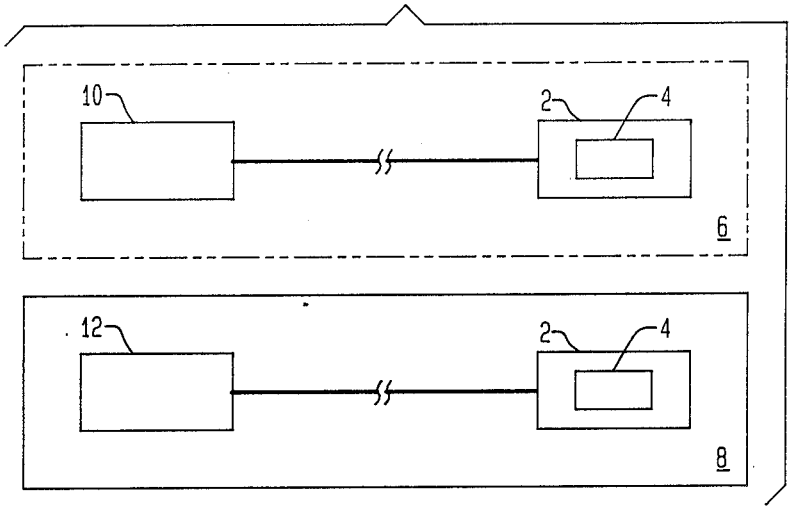
FIG. 1 schematically illustrates the environments in which the preferred embodiment is used.

FIG. 1 shows that a hearing aid 2 containing a circuit 4 in accordance with the invention is programmed at two locations: the factory 6 and the office 8 of the dispenser. Programming is accomplished by a programming unit 10 at the factory 6 and by another programming unit 12 at the office 8.

The details by which this programming is accomplished will be described in more detail below, but there are, advantageously, differences in the types of programming carried out at each location. At the factory 6, the unit 10 is used to program the circuit 4 to act like a particular hearing aid model and to make sure that the hearing aid 2 conforms to applicable specifications. Thus, where the circuit 4 does not produce the gain which is expected given the published specifications of the applicable hearing aid model, the unit 10 is used to bring the hearing aid into conformity with the published gain specifications. Additionally, and as is explained in more detail below, the unit 10 is used to program identification information into the circuit so that the type of circuit 4 can be determined by reading out the programmed information rather than by physical inspection of its constituent parts.

At the office 8, on the other hand, the dispenser seeks to tailor the circuit 4 to the particular needs of the patient. Accordingly, a different unit 12 is used for this. It would of course be possible to use a single unit for all programming purposes, both at the factory 6 and at the office 8, but this is not preferred because it is advantageous to make sure that the dispenser cannot carry out programming which should be carried out at the factory 6.

It will be understood that the nature of the programming and the advantageous use of two units 10 and 12 are not part of the invention. This is only preferred.

Figure 2:
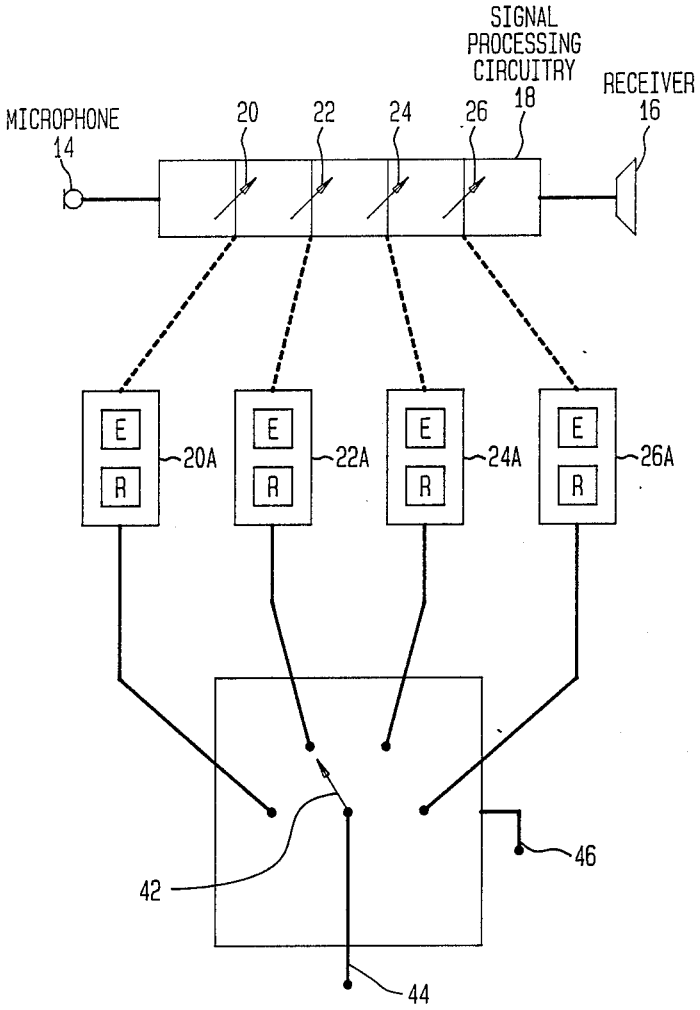
FIG. 2 is a more detailed schematic block diagram which illustrates a preferred embodiment of the invention.

The preferred embodiment is shown in more detail in FIG. 2. Here, it is assumed that the unit 10 is being used to program the circuit 4, but this is only exemplary.

The circuit 4 contains a microphone 14, a receiver 16 for transmitting sound to the patient's ear, and signal processing circuitry 18 which connects to the microphone 14 and receiver 16. The signal processing circuitry 18 is known by itself, and will be described in more detail below, but for the present purpose the circuitry 18 will be considered to have four controls 20, 22, 24 and 26. The functions of these controls 20–26 will be described below, but it only important now to note that the functioning of the circuitry 18 is controlled by these controls and that the values or states of these controls are programmed into the circuit 4 during the programming process. The number of controls is not part of the invention and the use of four controls is only preferred for reasons which are set forth in detail below.

Each of the controls 20–26 is associated with a corresponding unit 20A, 22A, 24A and 26A. Furthermore, each unit 20A,–26A contains a ring counter R and an EEPROM E. (The use of ring counters is not required, but is preferred, as is the use of the EEPROM.) The state of each unit 20A–26A determines the state of the control 20–26 with which that unit is associated, so that storing appropriate states in the units 20A–26A by programming is functionally equivalent to programming the circuit 4.

To store appropriate states in the units 20A–26A, digital pulses are introduced to the ring counters R. For example, if the ring counter R in unit 22A is in state 20 and it is desired to bring it to state 0, a digital pulse is routed to unit 22A. (In the preferred embodiment, the ring counter R in unit 22A is a modulus 21 ring counter.) This is accomplished by multiplexer 42, which is connected to a first input 44. The multiplexer 42 is itself a ring counter, but with a modulus of 12 (because, in the preferred embodiment, eleven pieces of information are stored. This will be discussed in more detail below.) The specific number of controls 20–26 is not a part of the invention, but a major feature of the invention is the ability to program for such a large number of controls; hearing aids currently manufactured by Siemens Hearing Instruments, Inc., contain no more than two trim potentiometers, i.e. two controls.

The state of the multiplexer 42 is determined by a second input 46. Thus, it is possible to program the entire circuit 4 using only three terminals: the first input 44, the second input 46, and ground (not shown). In use, the second input 46 is pulsed until the multiplexer 42 is in the desired state, i.e. is connected to the particular unit 20A, 22A–of interest. Then, pulses are input to the first input 44 until the unit (say 20A) is in the desired state. Next, a pulse is input to the second input 46 so that the first input 44 is connected to the unit 22A, and unit 22A is appropriately programmed by pulsing the first input 44. This process continues until all the units 20A–40A have been programmed, at which time the states of the ring counters R are stored in the EEPROMs E.

Advantageously, all the circuitry shown in FIG. 2 is implemented on a single hybrid circuit, with the exception of the microphone 14, the receiver 16, and the signal processing circuitry 18. The use of ring counters and EEPROMs is conducive to this implementation.

Figure 9:
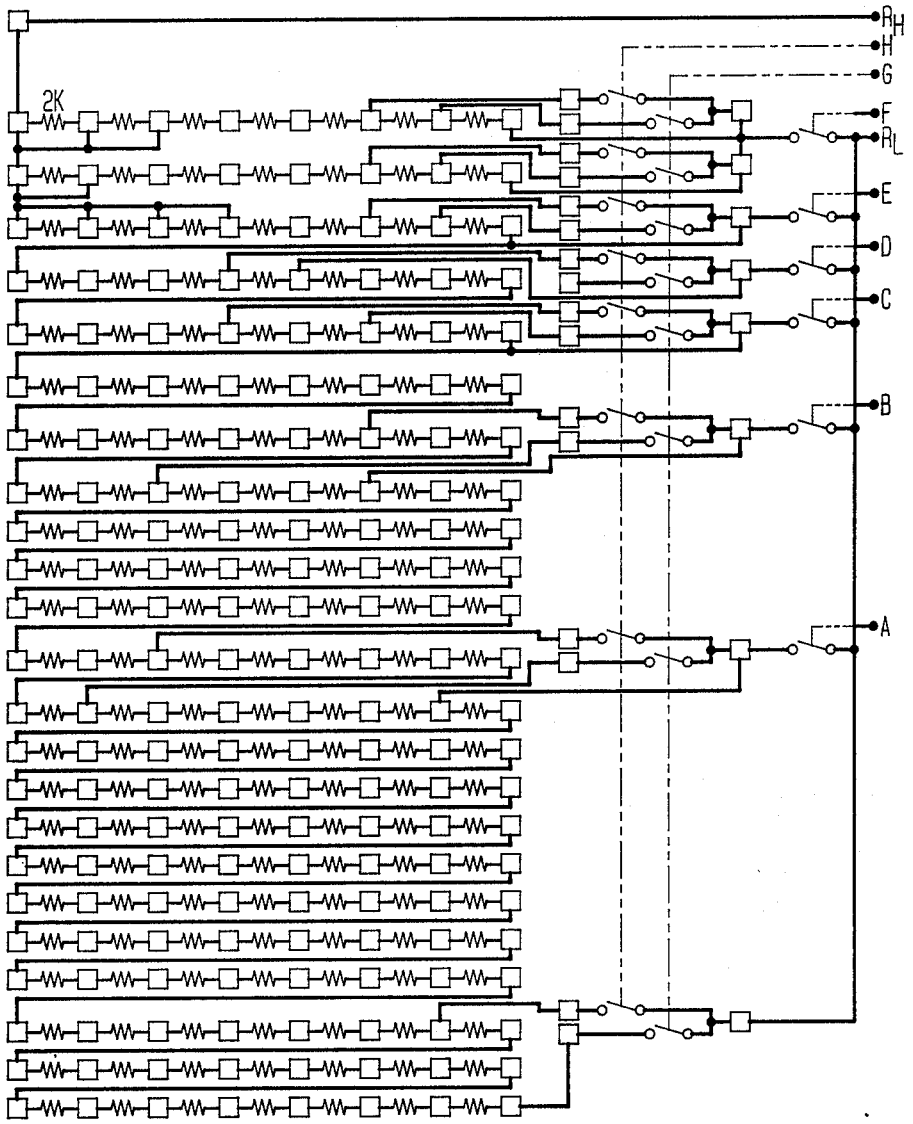
FIGS. 9–12 illustrate resistor and switch matrixes which produce the values shown in FIGS. 5–8.
Figure 10:
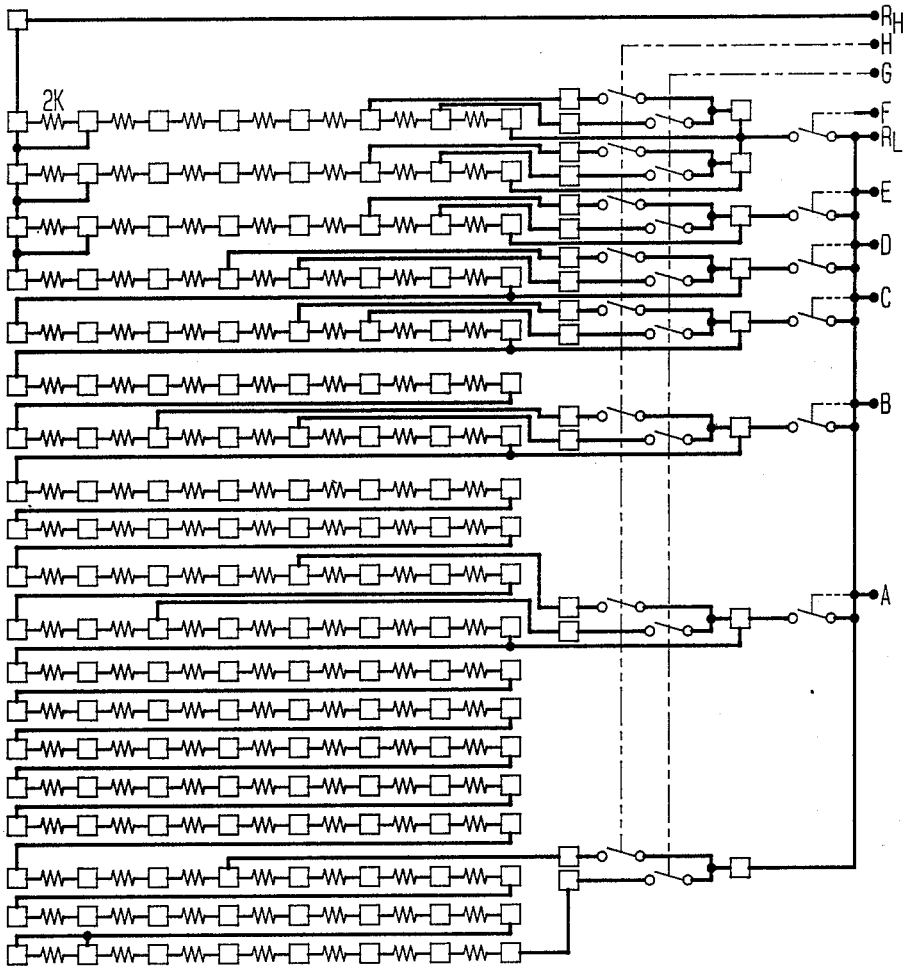
Figure 11:
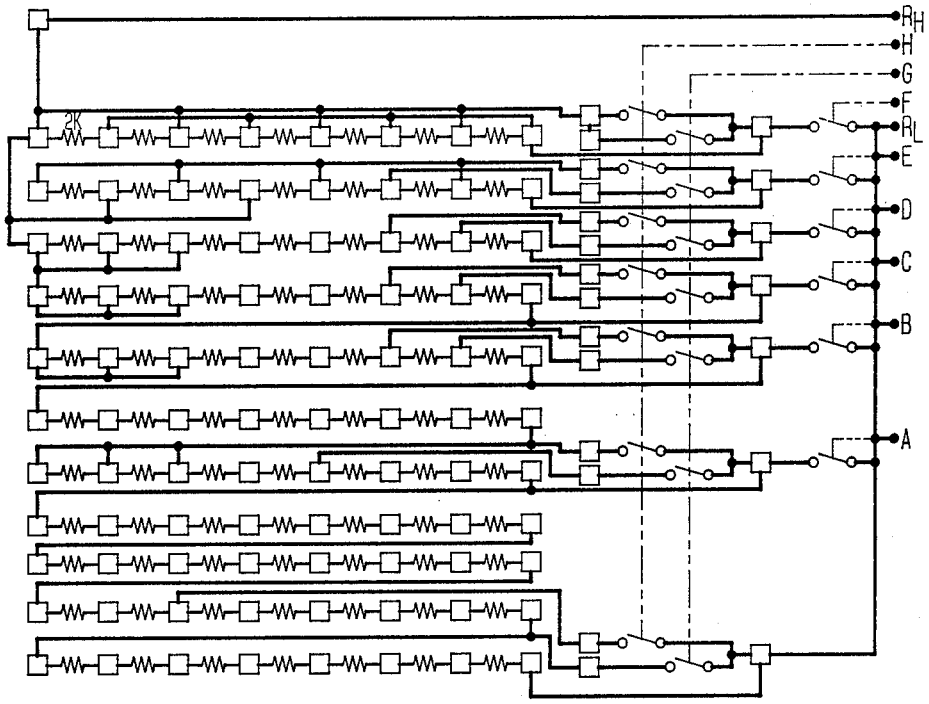
Figure 12:
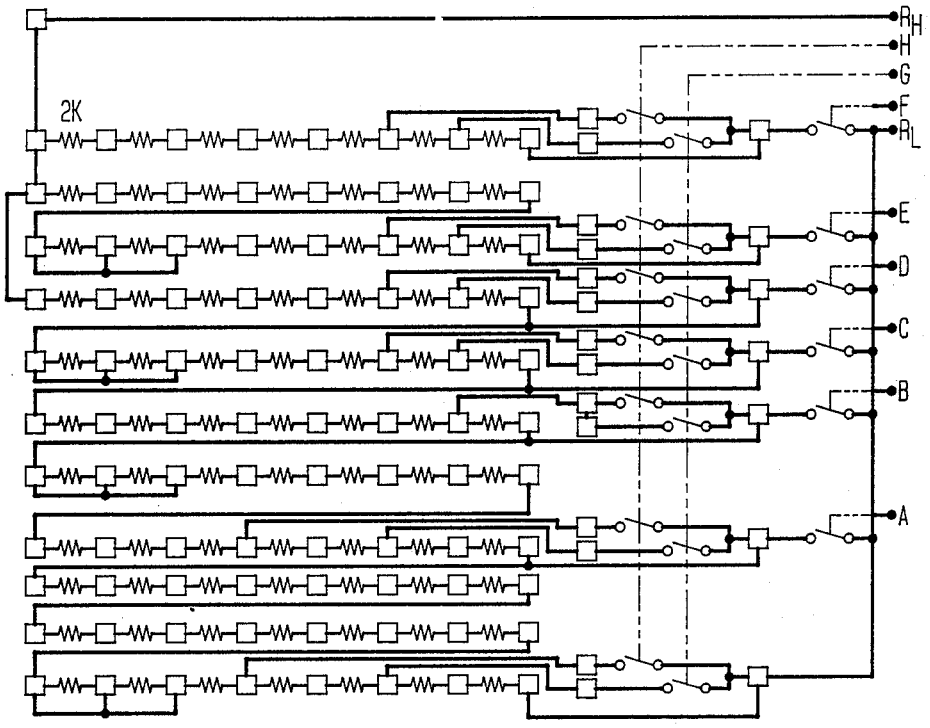

The nature of the controls 20,–26 will now be described in more detail, first in connection with FIGS. 3–8 and later in connection with FIG. 9.

Figure 3:
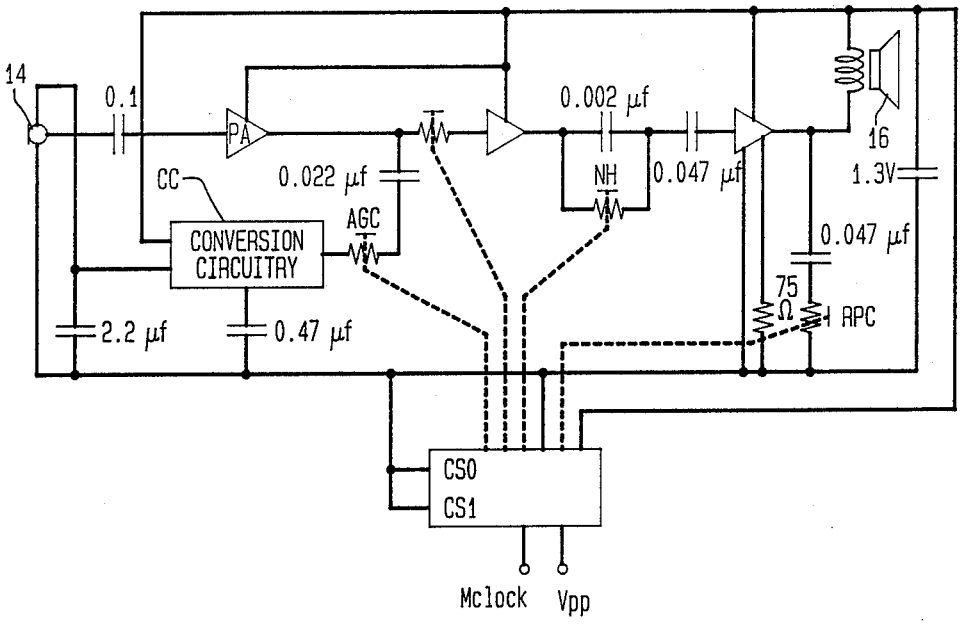
FIGS. 3 and 4 illustrate typical applications in which the preferred embodiment may be utilized.
Figure 4:
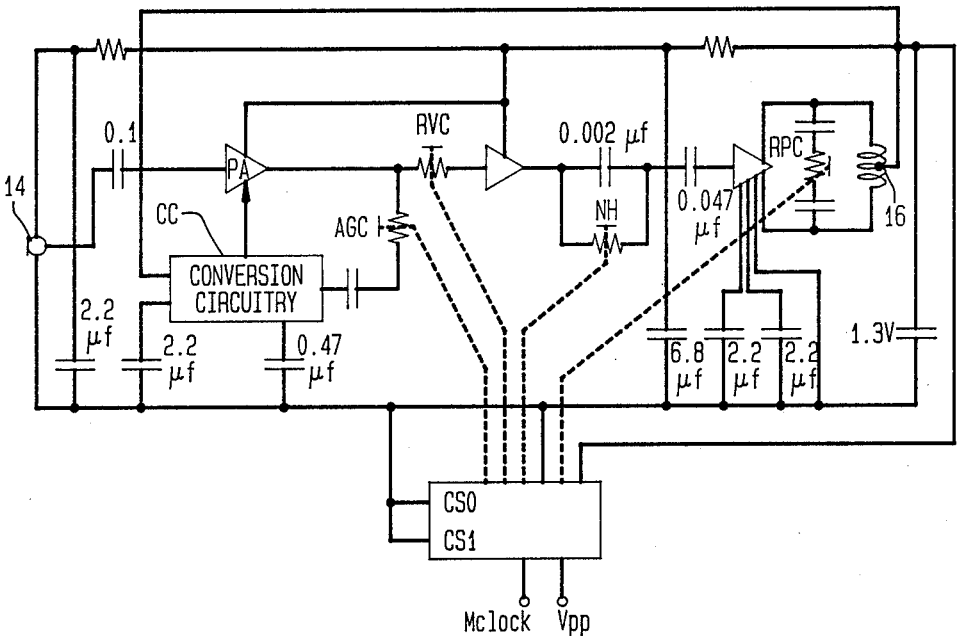
Figure 5:
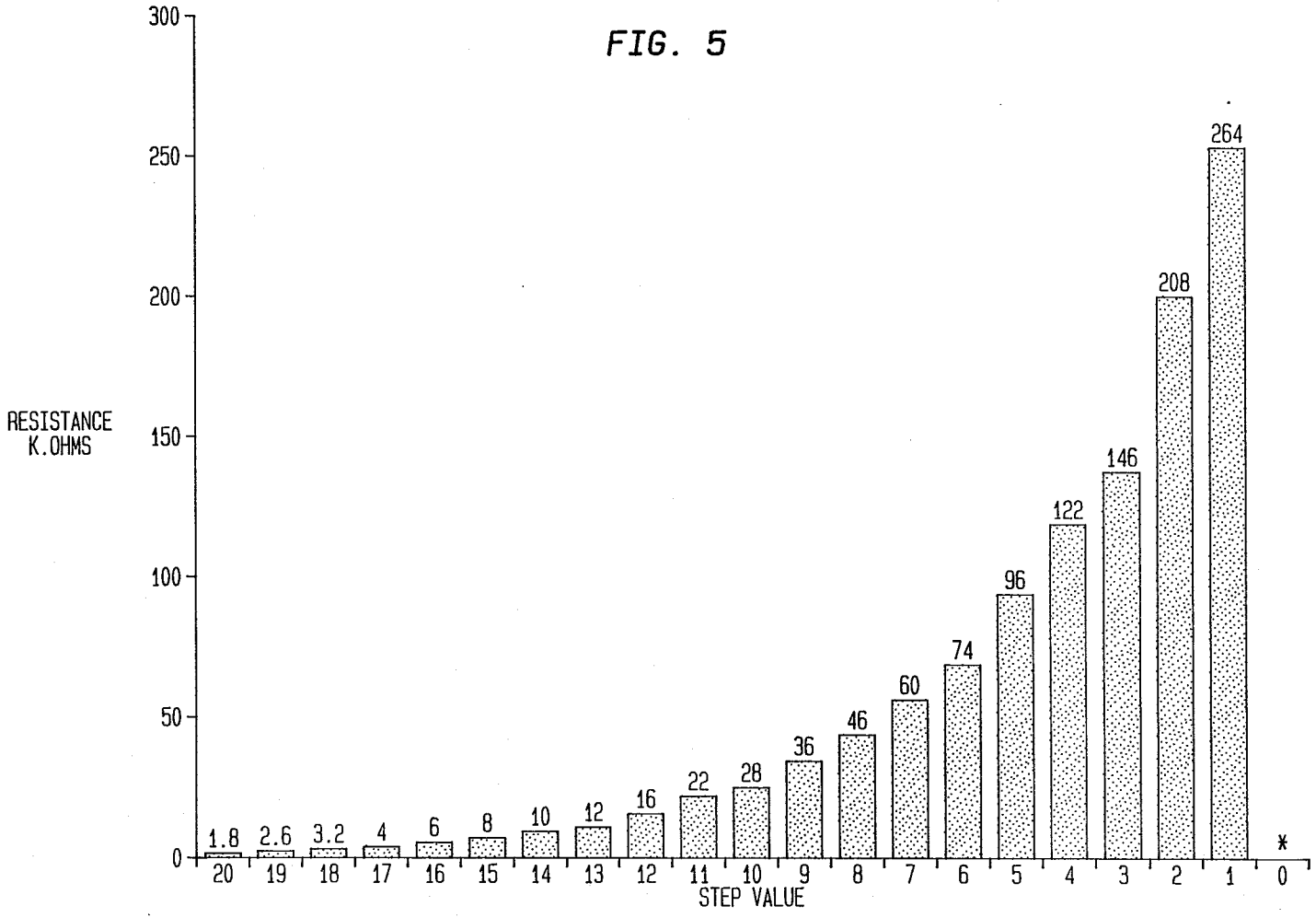
FIGS. 5–8 illustrate typical values for the variable resistances shown in FIGS. 3 and 4.
Figure 6:
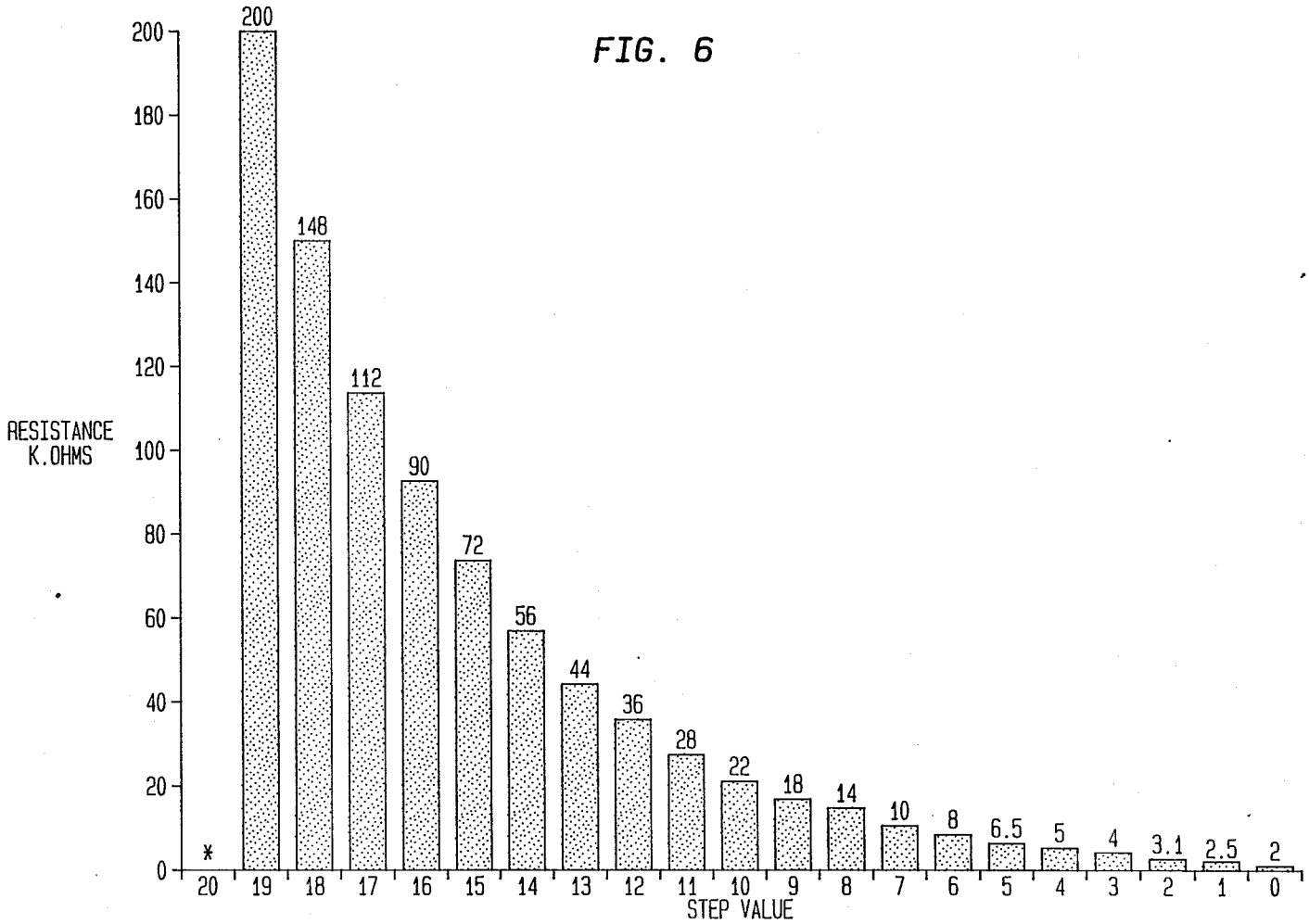
Figure 7:
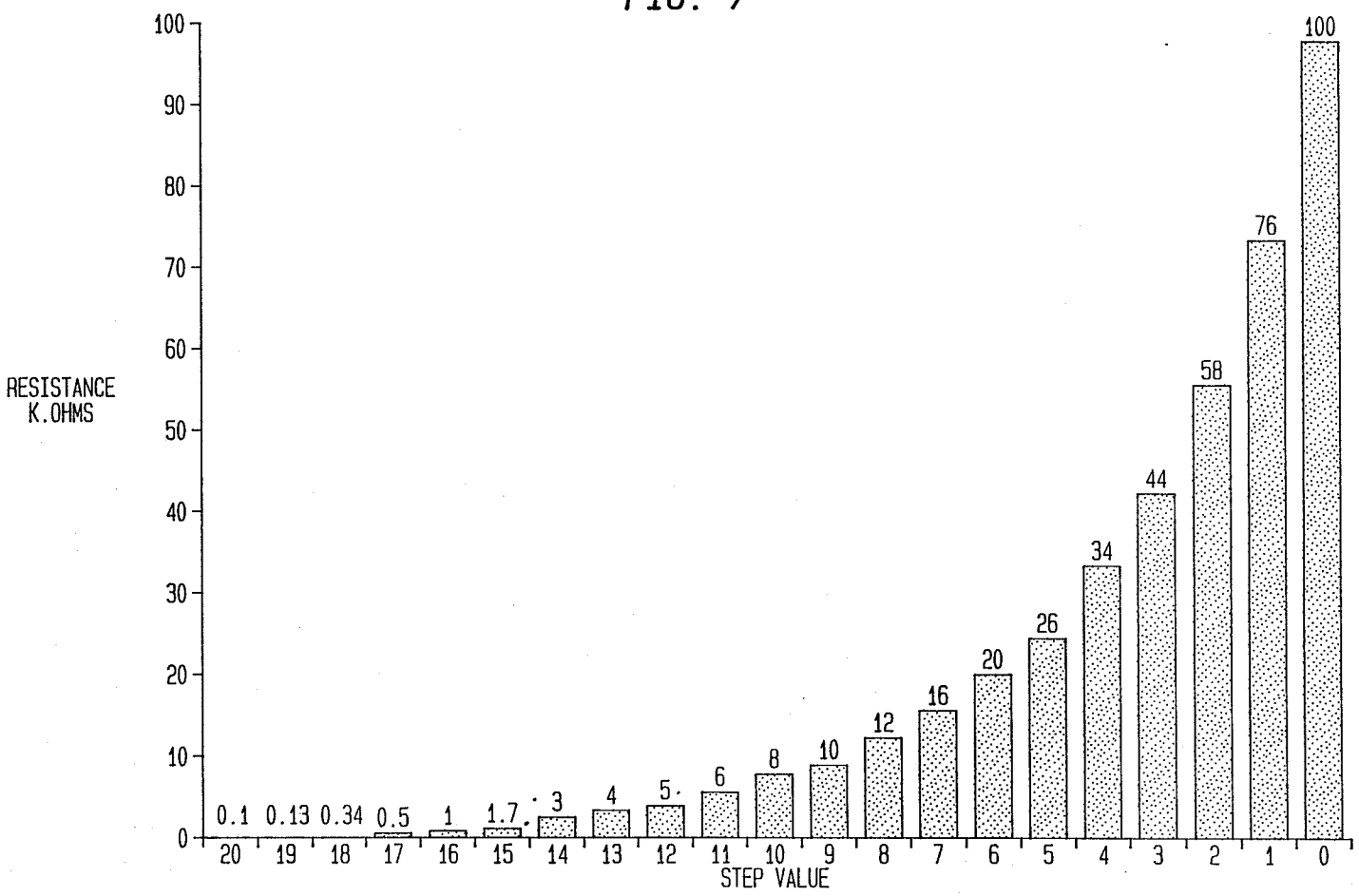
Figure 8:
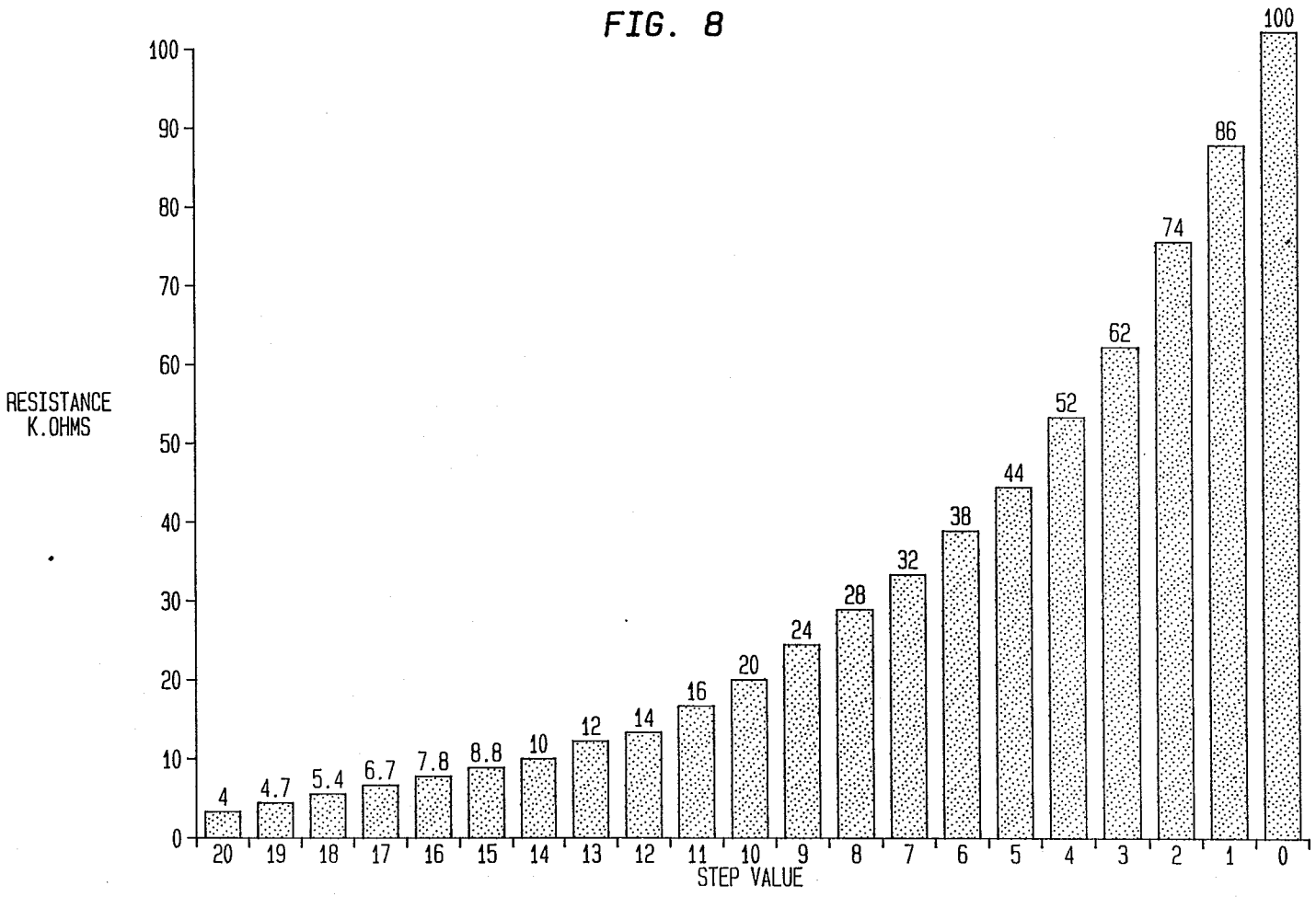

FIGS. 3 and 4 show two different circuit configurations which could be used for the signal processing circuitry block 14 illustrated in FIG. 2. (The illustrated configurations are exemplary and are not part of the invention.) In each configuration, there are four variable resistances: those labelled with the designations RVC, AGC, NH and RPC. RVC is an abbreviation for resistor volume control and performs the function of adjusting the overall gain of the circuit. AGC is an abbreviation for automatic gain control and adapts the amplification of the circuit to the ambient acoustic level. This is accomplished by converter circuitry CC, which converts the incoming AC to DC and, at some threshhold sound pressure level determined by the value of resistor AGC, provides a 3:1 compression ratio by appropriately biasing the preamplifier circuit PA. The converter circuitry CC is known to persons skilled in the art. NH is an abbreviation for normal-high pitch and is an adjustable high pass filter. When set at "normal", i.e. low resistance, the circuit has a broad-band response; when set at "high-pitch", i.e. high resistance, the circuit has a high-pass response. RPC is an abbreviation for resonant peak control and adjusts the impedance of the output stage of the hearing aid.

If implemented in a conventional hearing aid, each of these variable resistances would be a continuously variable potentiometer intended for mechanical adjustment. An ITE or canal hearing aid is far too small to contain four trim potentiometers. However, this is not so in accordance with the invention. In the preferred embodiment, these variable resistances are variable stepwise by electronic programming by the dispenser; FIGS. 5–8 show typical illustrative values which these resistances may have. In each case, the variable resistance is actually a matrix of resistors and switches; the open/closed states of the various switches determines the overall resistance of the entire network. FIGS. 9–12 show the particular resistor and switch networks which generate the resistances illustrated, respectively, in FIGS. 5–8. In the preferred embodiment, control 20 controls the AGC resistance, control 22 controls the NH resistance, control 24 controls the RPC resistance, and control 26 controls the RVC resistance.

It should be understood that, as sold to a dispenser, each hearing aid circuit 4 may not contain four adjustable controls. In practice, the dispenser orders only the circuit required for the particular application intended, and indeed may order circuit options which are not shown in the drawings. The invention does not do away with the need to add circuit components to hearing aid circuits, and is not a universal circuit in the sense of replacing all existing circuit models and being configurable by programming to act like any model required. However, the invention provides a highly versatile architecture for a hearing aid and reduces the customization required to produce a wide variety of circuit models.

It is important to note that the invention is not restricted to variation of analog quantities such as resistance etc. Pure switches could be used instead. It would for example be possible, in accordance with the invention, to provide electronic facilities for all possible controls in each circuit, but to use a programmable switch network to switch the controls into and out of the circuit. Thus, by appropriate factory programming, the same hearing aid circuit could be sold at different prices to different dispensers; where a dispenser required fewer controls, the price would be lower and a storing means could be programmed to prevent the dispenser from changing all but (for example) two circuit variables. Where, on the other hand, more controls would be desired, a higher price would be paid and factory programming of the storage means would permit the dispenser to adjust perhaps four circuit variables.

Figures 13, 13A:
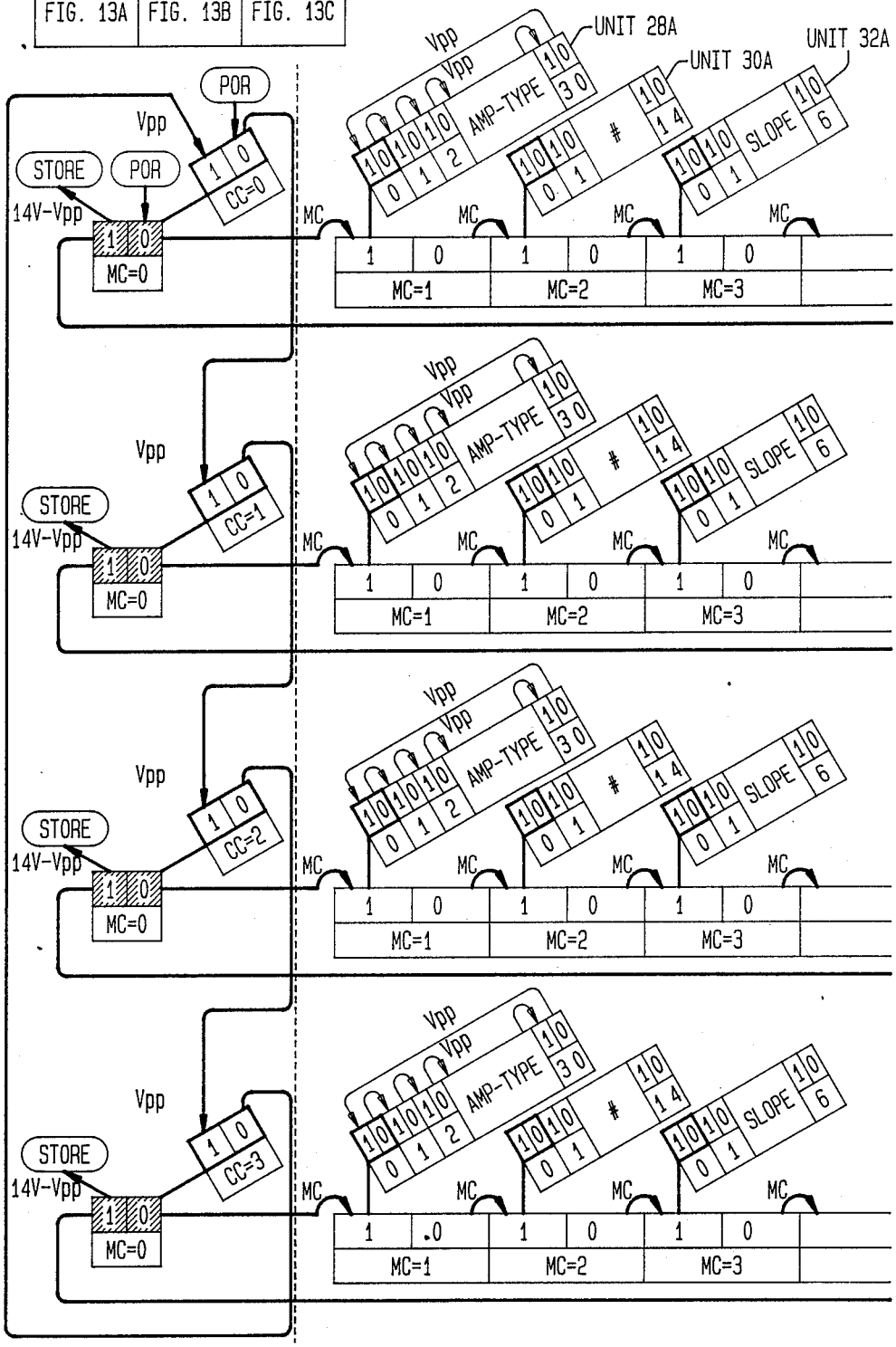
FIG. 13–13*c* illustrates the logical structure of the preferred embodiment.
Figure 13B:
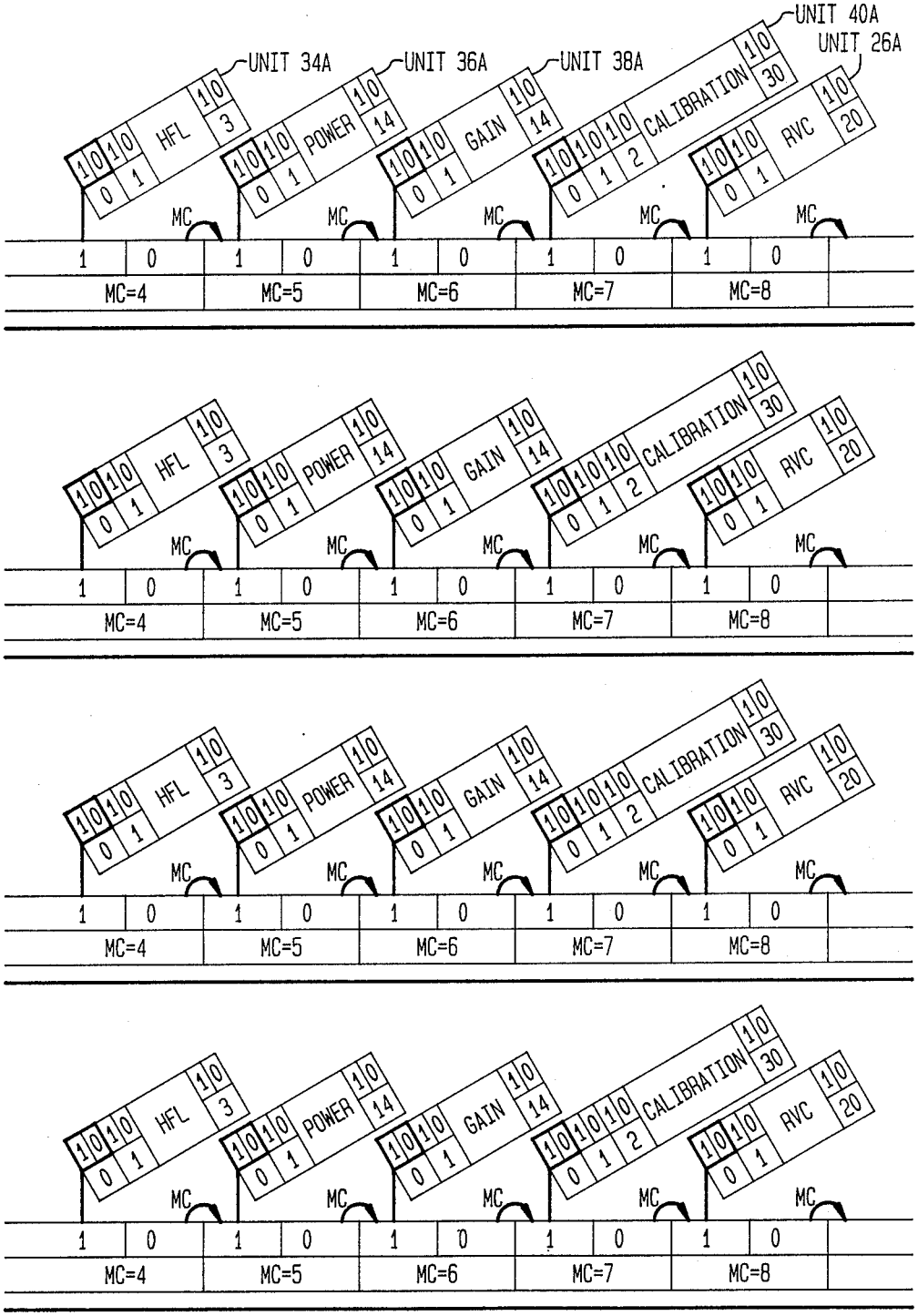
Figure 13C:
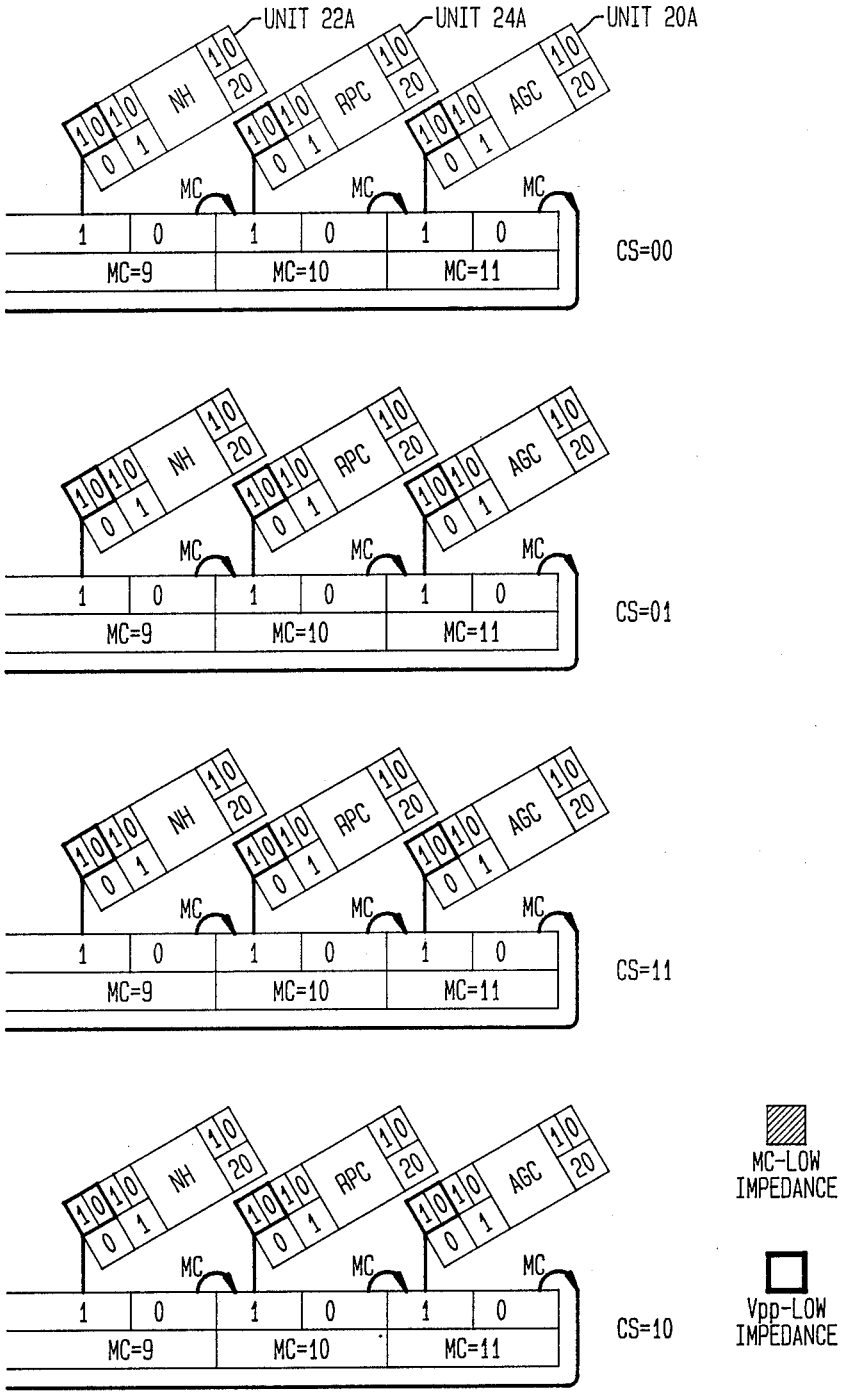

FIGS. 13–13*c* shows, in more detail, the actual logical implementation of the multiplexer 42 and the units 20A–40A. As a preliminary matter, it should be noted that units 28A, 30A–40A have no effect on the operation of the signal processing circuitry 18. These units are instead used to store identification information, so that the identity of the particular circuit 4 can be ascertained by reading out the contents of these seven units 28A–40A rather than by actually inspecting the circuit 4. Consequently, in the preferred embodiment units 28A–40A are all programmed at the factory and are never changed by the dispenser (although the dispenser's unit 12 may permit the contents of the units 28A–40A to be read out).

The multiplexer 42 is implemented as a modulus 12 ring counter, with states 0 through 11. In state 0, the index state, the impedance of the multiplexer 42 is low. This low impedance can be detected by the programming unit (not shown in FIG. 13) so that the programming unit and multiplexer are synchronized during the following programming procedure. In other words, the programmer may be set up to provide a continuous stream of pulses until a low impedance is detected, at which time the pulses are counted out in accordance with the programming desired.

The multiplexer 42 is then put into state 1 by inputting a digital pulse at second input 46. While the second input 46 is held high, pulses at the first digital input 44 will increment the ring counter R in unit 28A, which counter R is a modulus 30 ring counter. As in the case of the multiplexer 42, the ring counter R has a low impedance at its index state of 0, so that in practice pulses are delivered to the unit 28A until a low impedance is detected, indicating that the programming unit is synchronized with the unit 28A and that the next pulses must be counted properly to bring the contents of the ring counter to the proper value.

After the unit 28A has been properly programmed, the multiplexer 2 is advanced to state 2 by another pulse at the second input 46. While the second input 46 is held high, the ring counter R in the unit 30A is advanced by pulses at the first input 44 in the same manner; pulses are continuously delivered until the impedance is detected as low and then counted to bring the ring counter R in the unit 30A to the proper state. This process continues until all the ring counters R have been set to the intended states. In the preferred embodiment, the programming process stores the following information in the following units, in the order listed:

| Information | Storage Unit | Modulus |
|---|---|---|
| *Amplifier Type | 28A | 31 |
| *Number of Controls | 30A | 15 |
| *Low Frequency Rolloff | 32A | 7 |
| *High Frequency Limit | 34A | 4 |
| *Maximum Output (Pressure) | 36A | 15 |
| *Maximum Audio Gain | 38A | 15 |
| *Calibration | 40A | 31 |
| RVC Value | 26A | 21 |
| NH Value | 22A | 21 |
| RPC Value | 24A | 21 |
| AGC Value | 20A | 21 |

Information marked with an asterisk is information which identifies the circuit 4 but does not affect its operation. This information, which is not part of the invention, permits the circuit 4 to be compared with the data sheet which corresponds to it, so that the factory (and even the dispenser) can verify that the hearing aid conforms to the published specifications which are applicable to it. The modulus, which is not a part of the invention, indicates how much information is to be stored in the storage unit in question. Once the programming process has been completed, a high voltage pulse at the second input 46 causes the ring counter values to be stored in the corresponding EEPROMs.

In the preferred embodiment, the multiplexer 42 also includes a two-bit ring counter which can be incremented by applying pulses to the first input 44 while the second input 46 is held low. This two bit ring counter allows as many as four additional boards, advantageously hybrid circuits, to be connected in a single hearing aid and programmed using only the same inputs 44 and 46 as were discussed earlier. The two-bit ring counter also has a low impedance when in the 0 index state.

Those skilled in the art will understand that changes can be made in the preferred embodiments here described, and that these embodiments can be used for other purposes. Such changes and uses are within the scope of the invention, which is limited only by the claims which follow.

I claim:

1. A circuit for use in a programmable hearing aid, comprising:

a microphone;

a receiver;

signal processing circuitry operatively connected to the microphone and the receiver;

a plurality of variable electrical elements operatively connected to said circuitry and varying electrical characteristics thereof;

a plurality of means for storing information, each of said storing means being a ring counter which is operatively connected to at least a corresponding one of the variable electrical elements, having a plurality of states which correspond to electrical values of said at least one corresponding element, and causing said at least one corresponding elements to assume said values when in states corresponding thereto, said storing means changing between states upon receipt of digital pulses;

a first input adapted to receive said digital pulses;

a multiplexer comprising a ring counter which is operatively connected to said first input and to all of the storing means and selectively directing digital pulses at said first input to individual ones of the storing means; and a second input which is connected to said multiplexer.

2. The circuit of claim 1, wherein each ring counter has an index state with an impedance which is different from the impedances of all the other states.

3. The circuit of claim 1 wherein each of the storing means has a volatile section and a nonvolatile section.

4. The circuit of claim 3, wherein each nonvolatile section is an EEPROM.

5. The circuit of claim 1, wherein at least one of the variable electrical elements comprises a matrix of resistors and a matrix of switches which connect the resistors into different resistive configurations.

* * * * *